US008808026B2

(12) United States Patent
Yamaguchi et al.

(10) Patent No.: US 8,808,026 B2
(45) Date of Patent: Aug. 19, 2014

(54) WATERPROOF STRUCTURE

(75) Inventors: Yasuhiro Yamaguchi, Makinohara (JP); Mitsuhiro Matsumoto, Makinohara (JP); Sachiko Yagome, Makinohara (JP); Hajime Kato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/257,238

(22) PCT Filed: Apr. 22, 2010

(86) PCT No.: PCT/JP2010/057146

§ 371 (c)(1),
(2), (4) Date: Sep. 16, 2011

(87) PCT Pub. No.: WO2011/007607

PCT Pub. Date: Jan. 20, 2011

(65) Prior Publication Data

US 2012/0003856 A1 Jan. 5, 2012

(30) Foreign Application Priority Data

Jul. 17, 2009 (JP) ..... 2009-168997

(51) Int. Cl.
*H01R 13/73* (2006.01)

(52) U.S. Cl.
USPC ..... 439/559

(58) Field of Classification Search
USPC ..... 439/559, 548, 556, 271–276
See application file for complete search history.

(56) References Cited

U.S. PATENT DOCUMENTS

| | | | | | |
|---|---|---|---|---|---|
| 2,552,686 | A | * | 5/1951 | Melcher | 174/153 R |
| 3,091,748 | A | * | 5/1963 | Takes et al. | 439/248 |
| 3,398,391 | A | * | 8/1968 | Brishka | 439/559 |
| 3,719,918 | A | * | 3/1973 | Kerr | 439/319 |
| 3,977,750 | A | * | 8/1976 | Glover et al. | 439/320 |
| 4,099,825 | A | * | 7/1978 | Jackson | 439/188 |

(Continued)

FOREIGN PATENT DOCUMENTS

| | | | |
|---|---|---|---|
| DE | 1020040055874 | A1 | 5/2006 |
| EP | 1914847 | A2 | 4/2008 |

(Continued)

OTHER PUBLICATIONS

European Search Report; Application No. 10799669.6-1231/2456018; Oct. 30, 2012.

(Continued)

*Primary Examiner* — Ross Gushi
(74) *Attorney, Agent, or Firm* — Sughrue Mion, PLLC

(57) ABSTRACT

A waterproof structure, which is for one connector fixed to a mounting hole of an automotive motor's metallic case and another connector fixed to a mounting hole of an automotive inverter's metallic case and connected to the one connector, comprises ring-shaped first and second packings. The first packing resides between the one case's surface and the one connector's surface that are orthogonal to a fitting direction of the connectors such that the one case's mounting hole is surrounded thereby to provide waterproof interface between the one case and the one connector. The second packing resides between the other case's surface and the other connector's surface that are parallel to the fitting direction. The second packing extends on an outer circumferential surface of the other connector to provide waterproof interface between an inner circumferential surface of the other case's mounting hole and the other connector's outer circumferential surface.

9 Claims, 4 Drawing Sheets

(56) References Cited

U.S. PATENT DOCUMENTS

| | | | | |
|---|---|---|---|---|
| 4,295,701 | A * | 10/1981 | Gunn | 439/271 |
| 4,492,421 | A * | 1/1985 | Ito | 439/271 |
| 4,676,575 | A * | 6/1987 | Denlinger et al. | 439/271 |
| 4,697,859 | A * | 10/1987 | Fisher, Jr. | 439/246 |
| 4,705,339 | A * | 11/1987 | Hayes et al. | 439/277 |
| 5,417,587 | A * | 5/1995 | Katsuda et al. | 439/559 |
| 5,516,303 | A * | 5/1996 | Yohn et al. | 439/248 |
| 5,518,419 | A * | 5/1996 | Denyer et al. | 439/559 |
| 6,089,910 | A | 7/2000 | Suzuki et al. | |
| 6,113,424 | A * | 9/2000 | Shinozaki | 439/559 |
| 6,280,208 | B1 * | 8/2001 | Masuda et al. | 439/98 |
| 6,302,739 | B1 * | 10/2001 | Deno et al. | 439/607.17 |
| 6,422,899 | B1 * | 7/2002 | Miyazaki | 439/559 |
| 6,688,896 | B2 * | 2/2004 | Matsumoto | 439/98 |
| 6,796,838 | B2 * | 9/2004 | Yoshioka | 439/607.01 |
| 7,094,098 | B2 * | 8/2006 | Miyazaki | 439/559 |
| 7,097,498 | B2 * | 8/2006 | Miyazaki | 439/559 |
| 7,147,513 | B2 * | 12/2006 | Wada et al. | 439/607.43 |
| 7,226,317 | B2 * | 6/2007 | Wada et al. | 439/607.41 |
| 8,052,472 | B2 * | 11/2011 | Uchida | 439/607.28 |
| 8,092,252 | B2 * | 1/2012 | Peng | 439/559 |
| 8,147,272 | B2 * | 4/2012 | Rhein | 439/556 |
| 2002/0001987 | A1 * | 1/2002 | Murakami et al. | 439/271 |
| 2002/0031933 | A1 * | 3/2002 | Nakamura | 439/271 |
| 2002/0048983 | A1 * | 4/2002 | Lindner et al. | 439/271 |
| 2002/0115328 | A1 * | 8/2002 | Wakata | 439/271 |
| 2004/0214464 | A1 * | 10/2004 | Fukushima et al. | 439/271 |
| 2005/0082840 | A1 | 4/2005 | Ichida et al. | |
| 2008/0274635 | A1 * | 11/2008 | Shirai et al. | 439/271 |
| 2009/0035976 | A1 * | 2/2009 | Matsunaga | 439/271 |
| 2012/0003856 | A1 * | 1/2012 | Yamaguchi et al. | 439/271 |
| 2012/0208404 | A1 * | 8/2012 | Matsumoto et al. | 439/661 |
| 2012/0244746 | A1 * | 9/2012 | Tsuge et al. | 439/571 |

FOREIGN PATENT DOCUMENTS

| | | | |
|---|---|---|---|
| GB | 2029651 | A | 3/1980 |
| JP | 62-161774 | A | 10/1987 |
| JP | 7-282891 | A | 10/1995 |
| JP | 11-162554 | A | 6/1999 |
| JP | 2001-322439 | A | 11/2001 |
| JP | 2001322439 | A | 11/2001 |

OTHER PUBLICATIONS

Chinese Office Action dated Sep. 13, 2013, from the Chinese Patent Office issued in Chinese Patent Application No. 201080017372.5.

* cited by examiner

WATERPROOF STRUCTURE

TECHNICAL FIELD

The present invention relates generally to a waterproof structure for making waterproof inner spaces of one connector, another connector, one case of one electronic device, and another case of another electronic device, in the context of a specific configuration where the one connector is fixed to the one case of the one electronic device, the other connector is fixed to the other case of the other electronic device, and the one connector and the other connector are adapted to be directly connected to each other.

BACKGROUND ART

Automobiles incorporate various electronic devices. Conventionally, wiring harnesses have been used to connect these electronic devices to each other. The wiring harness comprises electric wires and connectors attached to ends of the electric wires. Each of the connectors of the wiring harness is connected to corresponding each of connectors each fixed to cases of the electronic devices, so that these electronic devices are connected to each other.

Meanwhile, in recent years, the connectors of the electronic devices are directly connected to each other as illustrated in FIGS. 3 and 4 without use of the wiring harnesses in view of costs and workability in assembly (for example, see the patent literature PTL 1).

FIGS. 3 and 4 illustrate a waterproof structure 200 in a structure where (a) a connector 201 fixed to a mounting hole 11*a* of a case 11 of a motor incorporated in an automobile is connected to (b) a connector 202 fixed to a mounting hole 12*a* of a case 12 of an inverter.

The connector 201 includes a terminal accommodating portion 204 adapted to accommodate a terminal 205, and an outer housing 203 having a shape of a cylinder that opens toward the connector 202, the outer housing 203 fixed to a case 11 and adapted to accommodate therein the terminal accommodating portion 204.

The outer housing 203 includes (a) a cylindrical portion 231 positioned inward of a mounting hole 11*a* and adapted to accommodate therein the terminal accommodating portion 204, and (b) an overlapping portion 235 extending in a flange-like manner from an end of the cylindrical portion 231 and outward of the cylindrical portion 231, the end being a proximal end with respect to the connector 202.

The overlapping portion 235, which is disposed on and in contact with an outer surface 11*b* of the case 11, has a shape of a ring surrounding the mounting hole 11*a* of the case 11. Also, the overlapping portion 235 includes (a) a first groove 235*a* provided in a concave manner on a surface abutting the outer surface 11*b* of the case 11 and provided in a ring shape over an entire circumference of the overlapping portion 235, and (b) a second groove 235*b* provided in a concave manner on a surface abutting the outer surface 12*b* of the case 12 of the inverter and provided over an entire circumference of the overlapping portion 235.

A first packing 208*a* is attached into the first groove 235*a*. Also, a second packing 208*b* is attached into the second groove 235*b*.

The connector 202 includes (a) a terminal 207 adapted to be connected to a terminal 205 of the connector 201 and (b) a connector housing 206 adapted to accommodate the terminal 207 and fixed to the case 12.

In the waterproof structure 200 as illustrated in FIG. 4, the overlapping portion 235 of the connector 201 and the outer surface 12*b* of the case 12 of the inverter are brought into abutment with each other when the connector 201 is connected to the connector 202, so that the second packing 208*b* makes waterproof the interface between the overlapping portion 235 and the case 12. Also, the first packing 208*a* makes waterproof the interface between the overlapping portion 235 and the case 11. In this manner, water indicated by an arrow in FIG. 4 entering a space between the cases 11, 12 is prevented from entering the cases 11, 12 via an interface between the mounting hole 11*a* and the connector 201 and an interface between the mounting hole 12*a* and the connector 202, and from entering inner spaces of the connectors 201, 202.

CITATION LIST

Patent Literature

PTL 1: Japanese Patent Application Laid-Open Publication No. 2001-322439

SUMMARY OF THE INVENTION

Technical Problem

However, the following drawbacks are found in the above-described waterproof structure 200. Specifically, in the waterproof structure 200, since the second packing 208*b* is provided between the overlapping portion 235 and the case 12 of the inverter, the overlapping portion 235 and accordingly the connector 201 are pressed by the case 12 of the inverter and placed under stress in a state where the connector 201 and the connector 202 are connected to each other, which is an undesirable situation.

Also, when there is an error associated with assembly of the connector 201 or the connector 202, the connector 201 is pressed by a larger force caused by the case 12 of the inverter, resulting in presence of an excessive stress, which may cause damage to the connector 201.

Further, in addition to the above drawbacks associated with the waterproof structure 200, friction is created between the second packing 208*b* and the outer surface 12*b* of the case 12 due to vibrations of the case 11 or the case 12, which may degrade waterproof performance of the second packing 208*b*.

In view of the above drawbacks, an object of the present invention is to provide a waterproof structure in a structure where the connectors fixed to the cases are directly connected to each other that can making the inside of the cases reliably waterproof, and avoid damage to the connectors.

Solution to Problem

In order to attain the above-described objectives, according to a first aspect of the present invention, there is provided a waterproof structure for one connector fixed to a mounting hole of one case and an other connector fixed to a mounting hole of an other case, the other connecter being constructed to be connected to the one connector.

The waterproof structure comprises a ring-shaped first packing and a ring-shaped second packing.

The ring-shaped first packing is provided between a surface of the one case and a surface of the one connector and extending such that the mounting hole of the one case is surrounded thereby. The first packing is constructed to keep waterproof an interface between the one case and the one connector. The surfaces of the one case and the one connector extend orthogonal to a fitting direction of the connectors such that the interface of the one case and the one connector is defined by the surfaces of the one case and the one connector.

The ring-shaped second packing is provided between a surface of the other case and an outer circumferential surface of the other connector and extending on the outer circumferential surface of the other connector. The second packing is constructed to keep waterproof an interface between the other case and the outer circumferential surface of the other connector. The surfaces of the other case and the other connector extend parallel to the fitting direction such that the interface of the other case and the other connector is defined by the surface of the other case and the outer circumferential surface of the other connector.

According to a second aspect of the present invention in the context of the first aspect thereof, one of the one connector and the other connector includes one terminal accommodating portion accommodating one terminal, and an other of the one connector and the other connector includes an other terminal accommodating portion accommodating an other terminal adapted to be connected to the one terminal. The other terminal accommodating portion has a cylindrical shape and configured to accommodate therein the one terminal accommodating portion.

A ring-shaped third packing is provided between an outer circumferential surface of the one terminal accommodating portion and an inner circumferential surface of the other terminal accommodating portion. The third packing is constructed to keep waterproof an interface between the outer circumferential surface of the one terminal accommodating portion and the inner circumferential surface of the other terminal accommodating portion. The interface is defined by the outer circumferential surface and the inner circumferential surface.

According to a third aspect of the present invention in the context of the first aspect thereof, one of the one connector and the other connector includes a terminal accommodating portion and an outer housing.

The terminal accommodating portion is constructed to accommodate a terminal. The outer housing is fixed to a corresponding one of the one case and the other case.

The outer housing is provided in a shape of a cylinder having a bottom and opening toward the other of the one connector and the other connector. Also, the outer housing is adapted to accommodate therein the terminal accommodating portion movably in a direction orthogonal to the fitting direction.

Further, a recess is provided in a shape of a dent on an inner bottom surface of the outer housing and positioning therein the terminal protruding from the terminal accommodating portion.

Also, a ring-shaped fourth packing is provided between the inner bottom surface of the outer housing and the terminal accommodating portion and is adapted to keep waterproof an interface between the inner bottom surface of the outer housing and the terminal accommodating portion. The recess is surrounded by the fourth packing.

According to a fourth aspect of the present invention in the context of the second aspect thereof, one of the one connector and the other connector includes a terminal accommodating portion and an outer housing.

The terminal accommodating portion is constructed to accommodate a terminal. The outer housing is fixed to a corresponding one of the one case and the other case.

The outer housing is provided in a shape of a cylinder having a bottom and opening toward the other of the one connector and the other connector. Also, the outer housing is adapted to accommodate therein the terminal accommodating portion movably in a direction orthogonal to the fitting direction.

Further, a recess is provided in a shape of a dent on an inner bottom surface of the outer housing and positioning therein the terminal protruding from the terminal accommodating portion.

Also, a ring-shaped fourth packing is provided between the inner bottom surface of the outer housing and the terminal accommodating portion and is adapted to keep waterproof an interface between the inner bottom surface of the outer housing and the terminal accommodating portion. The recess is surrounded by the fourth packing.

According to a fifth aspect of the present invention in the context of the first aspect thereof, the one connector includes a ring-shaped overlapping portion extending such that the mounting hole of the one case is surrounded by the overlapping portion. The overlapping portion is configured to be disposed on and in contact with an outer surface of the one case. The first packing is attached to the overlapping portion such that the first packing is in intimate contact with the outer surface of the one case.

According to a sixth aspect of the present invention in the context of the second aspect thereof, the one connector includes a ring-shaped overlapping portion extending such that the mounting hole of the one case is surrounded by the overlapping portion. The overlapping portion is configured to be disposed on and in contact with an outer surface of the one case. The first packing is attached to the overlapping portion such that the first packing is in intimate contact with the outer surface of the one case.

According to a seventh aspect of the present invention in the context of the third aspect thereof, the one connector includes a ring-shaped overlapping portion extending such that the mounting hole of the one case is surrounded by the overlapping portion. The overlapping portion is configured to be disposed on and in contact with an outer surface of the one case. The first packing is attached to the overlapping portion such that the first packing is in intimate contact with the outer surface of the one case.

According to an eighth aspect of the present invention in the context of the fourth aspect thereof, the one connector includes a ring-shaped overlapping portion extending such that the mounting hole of the one case is surrounded by the overlapping portion. The overlapping portion is configured to be disposed on and in contact with an outer surface of the one case. The first packing is attached to the overlapping portion such that the first packing is in intimate contact with the outer surface of the one case.

According to a ninth aspect of the present invention in the context of the first aspect thereof, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to a tenth aspect of the present invention in the context of the second aspect thereof, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to an eleventh aspect of the present invention in the context of the third aspect thereof, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to a twelfth aspect of the present invention in the context of the fourth aspect thereof, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to a thirteenth aspect of the present invention in the context of the fifth aspect, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to a fourteenth aspect of the present invention in the context of the sixth aspect, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to a fifteenth aspect of the present invention in the context of the seventh aspect thereof, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

According to a sixteenth aspect of the present invention in the context of the eighth aspect thereof, the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

Advantageous Effects of the Invention

With the construction and arrangement of the invention according to the first aspect, the ring-shaped first packing is provided between the surfaces of the one case and the one connector and extending such that the mounting hole of the one case is surrounded thereby, the first packing being constructed to keep waterproof the interface between the one case and the one connector, wherein the surfaces of the one case and the one connector extend orthogonal to the fitting direction of the connectors. Also, the ring-shaped second packing is provided between the surfaces of the other case and the other connector and extending on an outer circumferential surface of the other connector, the second packing being constructed to keep waterproof the interface between the other case and the outer circumferential surface of the other connector, wherein the surfaces of the other case and the other connector extend parallel to the fitting direction.

Accordingly, by virtue of the first packing, entry of water into the one case via the interface between the mounting hole of the one case and the one connector. Also, by virtue of the second packing, entry of the water into the other case via the mounting hole of the other case and the other connector is effectively prevented.

Further, since neither the first packing nor the second packing is provided between the one case (or the one connector) and the other case (or the other connector), the connectors are not excessively pressed by the mating cases or the connectors when the connectors are connected to each other even when there is an error in assembly associated with the connectors. Accordingly, it is possible to prevent an excessive stress from acting upon the connectors and avoid damage to the connectors.

Also, the first packing is not in contact with the other case or the other connector, or the second packing is not in contact with the one case or the one connector. Accordingly, even when vibration occurs in the one case or the other case, the first packing will not experience friction with the other case or the other connector causing degradation in waterproof performance of the first packing, or the second packing will not experience friction with the one case or the one connector causing degradation in waterproof performance of the second packing. Accordingly, it is possible to provide a waterproof structure that effectively make the case waterproof and avoid damage to the connector.

With the construction and arrangement of the invention according to the second aspect, one of the one connector and the other connector includes the one terminal accommodating portion accommodating one terminal, and the other of the one connector and the other connector includes the other terminal accommodating portion accommodating an other terminal adapted to be connected to the one terminal. The other terminal accommodating portion has the cylindrical shape and configured to accommodate therein the one terminal accommodating portion. Also, the ring-shaped third packing is provided between the outer circumferential surface of the one terminal accommodating portion and the inner circumferential surface of the other terminal accommodating portion, wherein the third packing being constructed to keep waterproof the interface between the outer circumferential surface of the one terminal accommodating portion and the inner circumferential surface of the other terminal accommodating portion.

Accordingly, by virtue of the third packing, entry of the water into the one terminal accommodating portion and the other terminal accommodating portion is effectively prevented.

With the construction and arrangement of the invention according to the third or fourth aspect, one of the one connector and the other connector includes (i) the terminal accommodating portion constructed to accommodate a terminal and (ii) the outer housing fixed to a corresponding one of the one case and the other case, wherein the outer housing has the cylindrical shape having the bottom and opening toward the other of the one connector and the other connector, the outer housing being adapted to accommodate therein the terminal accommodating portion movably in a direction orthogonal to the fitting direction. Further, the recess in the shape of the dent is provided on the inner bottom surface of the outer housing to position therein the terminal protruding from the terminal accommodating portion. Also, the ring-shaped fourth packing is provided between the inner bottom surface of the outer housing and the terminal accommodating portion and is adapted to keep waterproof the interface between the inner bottom surface of the outer housing and the terminal accommodating portion, wherein the recess is surrounded by the fourth packing.

Accordingly, by virtue of the fourth packing, it is made possible to effectively prevent entry of the water into the recess and the terminal accommodating portion via the interface between the inner bottom surface of the outer housing and the terminal accommodating portion.

With the construction and arrangement of the invention according to any of the fifth to eighth aspects, the one connector includes the ring-shaped overlapping portion extending such that the mounting hole of the one case is surrounded by the overlapping portion, the overlapping portion being configured to be disposed on and in contact with the outer surface of the one case. The first packing is attached to the overlapping portion such that the first packing is in intimate contact with the outer surface of the one case.

Accordingly, by virtue of the first packing, the interface between the overlapping portion and the mounting hole of the one case is kept waterproof, and thus entry of the water into the one case via the interface between the mounting hole of the one case and the one connector is effectively prevented.

With the construction and arrangement of the invention according to any of the ninth to sixteenth aspects, the other connector includes the mounting-hole-inserted portion adapted to be positioned inside of the mounting hole of the other case, and the second packing is attached to the outer circumferential surface of the mounting-hole-inserted portion such that the second packing is in intimate contact with the inner circumferential surface of the mounting hole of the other case.

Accordingly, by virtue of the second packing, the interface between the outer circumferential surface of the mounting-hole-inserted portion and the inner circumferential surface of the mounting hole of the other case are kept waterproof and thus entry of the water into the other case via the interface is effectively prevented.

DESCRIPTION OF EXEMPLARY EMBODIMENT

Figure 1:
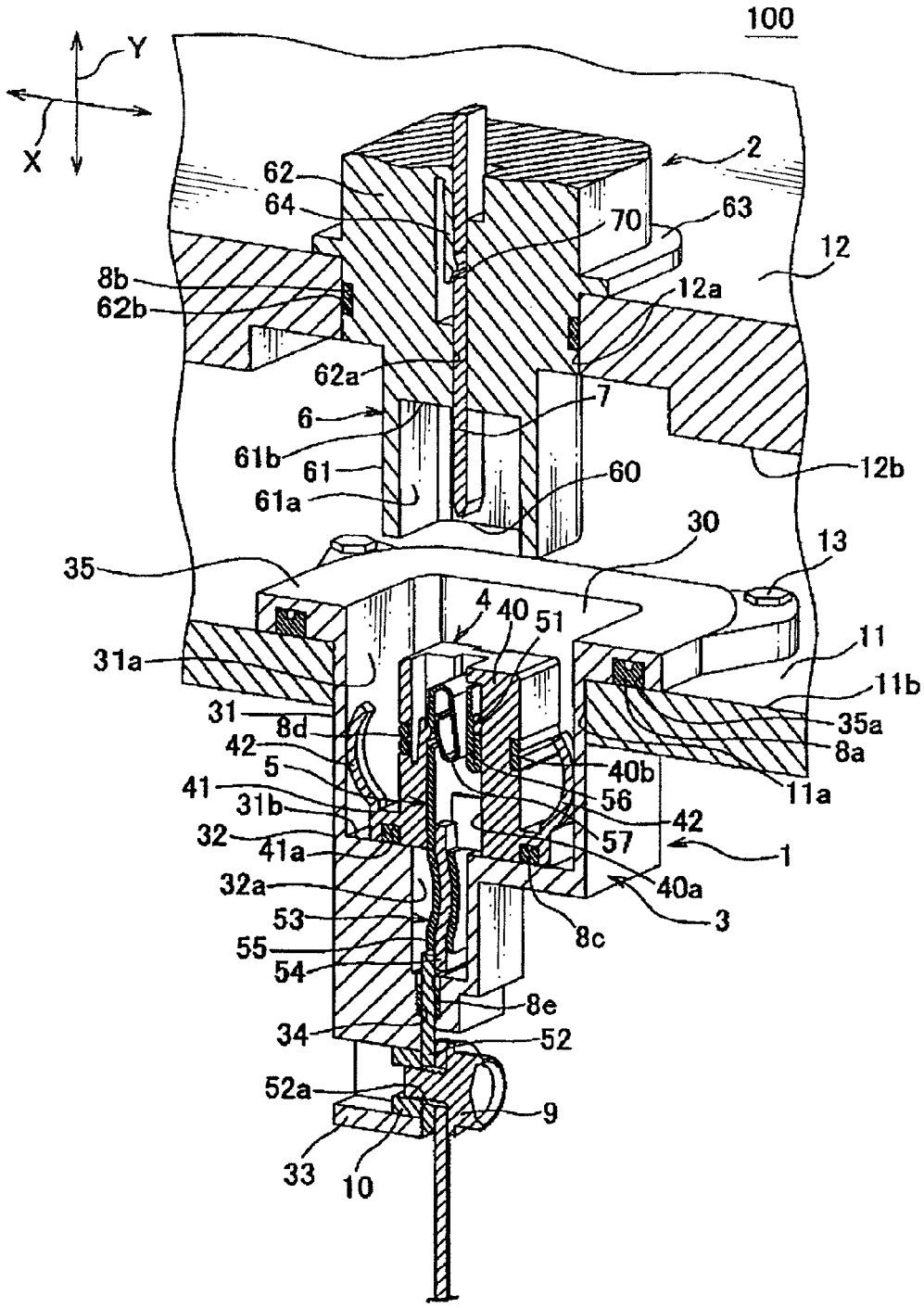
FIG. 1 is a perspective view in cross section of a water proof structure according to one embodiment of the present invention in the case and in the connector.
Figure 2:
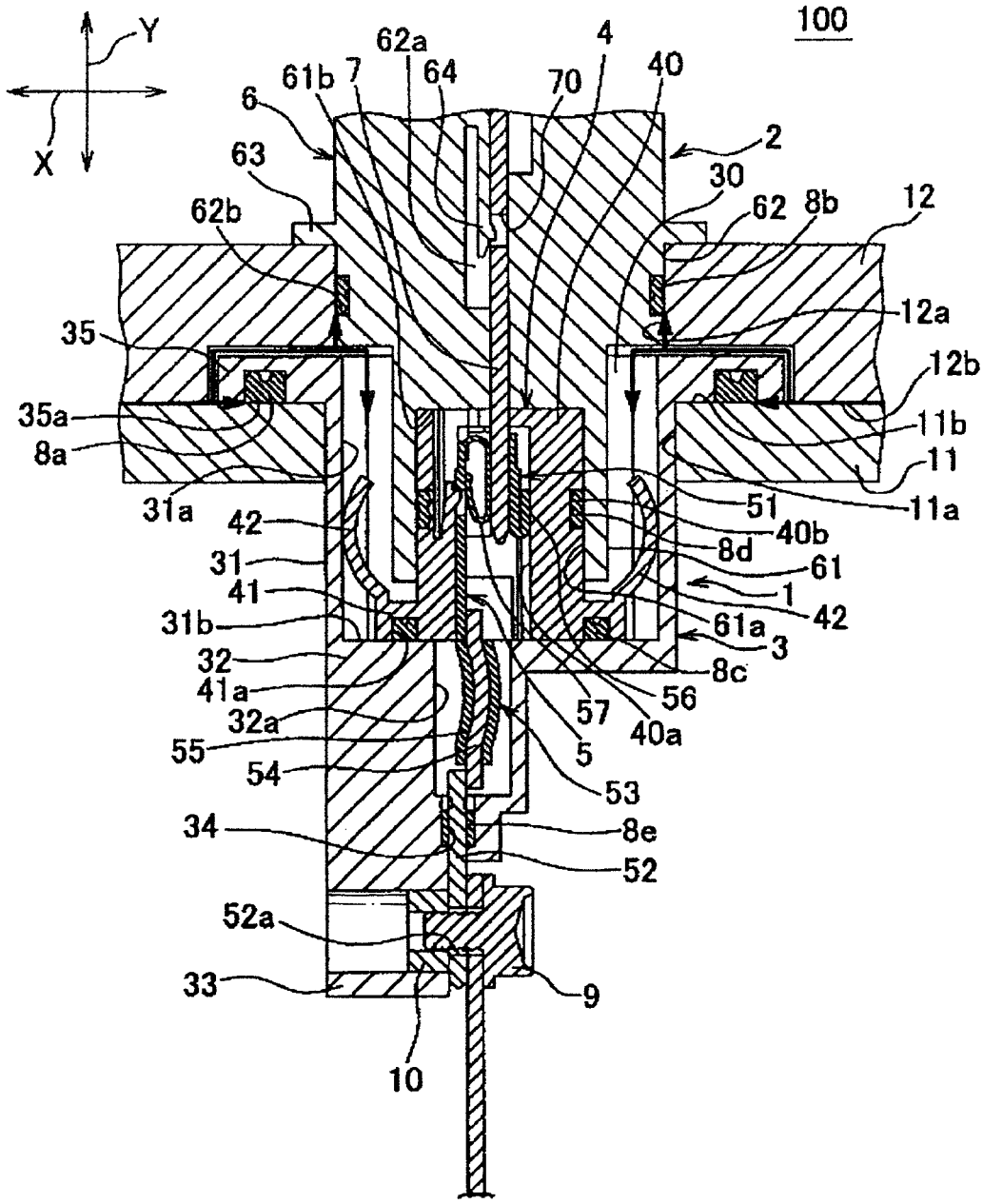
FIG. 2 is a cross-sectional view of the waterproof structure illustrated in FIG. 1.
Figure 3:
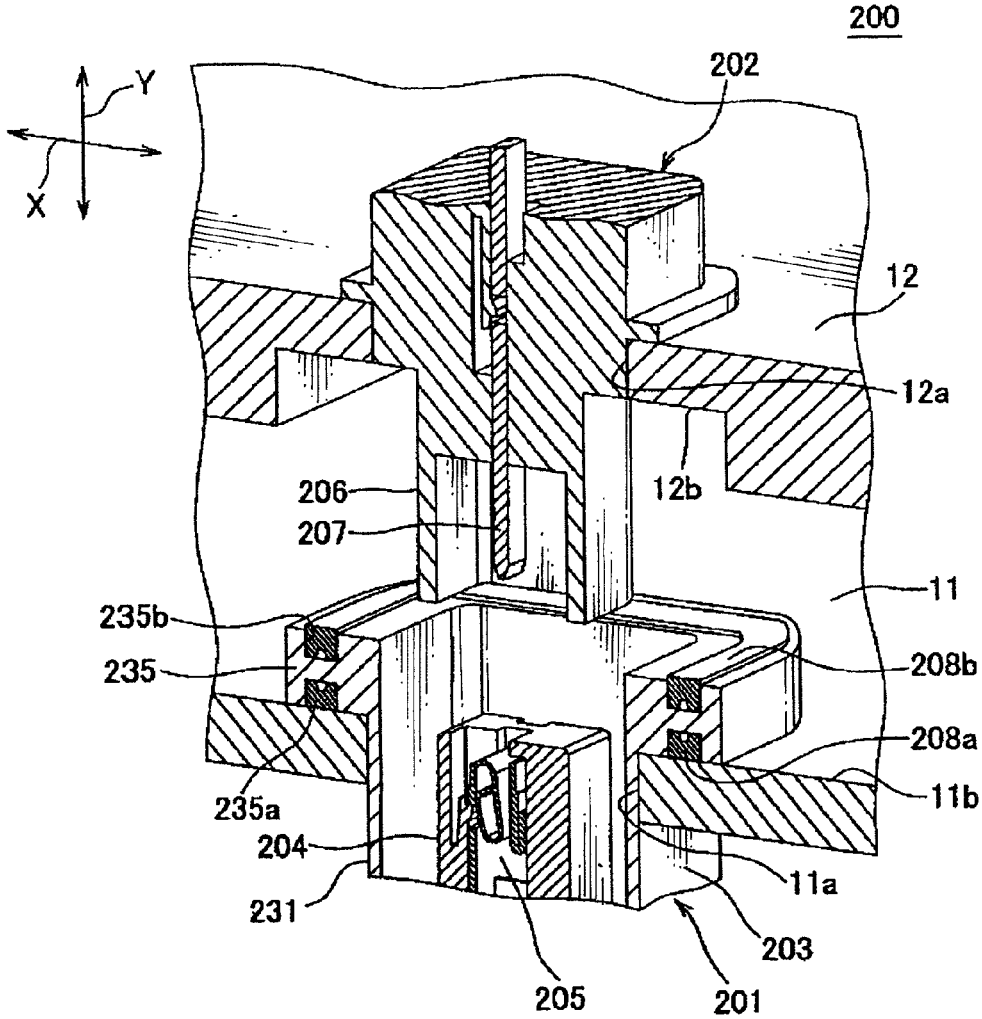
FIG. 3 is a perspective view in cross section of a waterproof structure in a conventional case and in a conventional connector.
Figure 4:
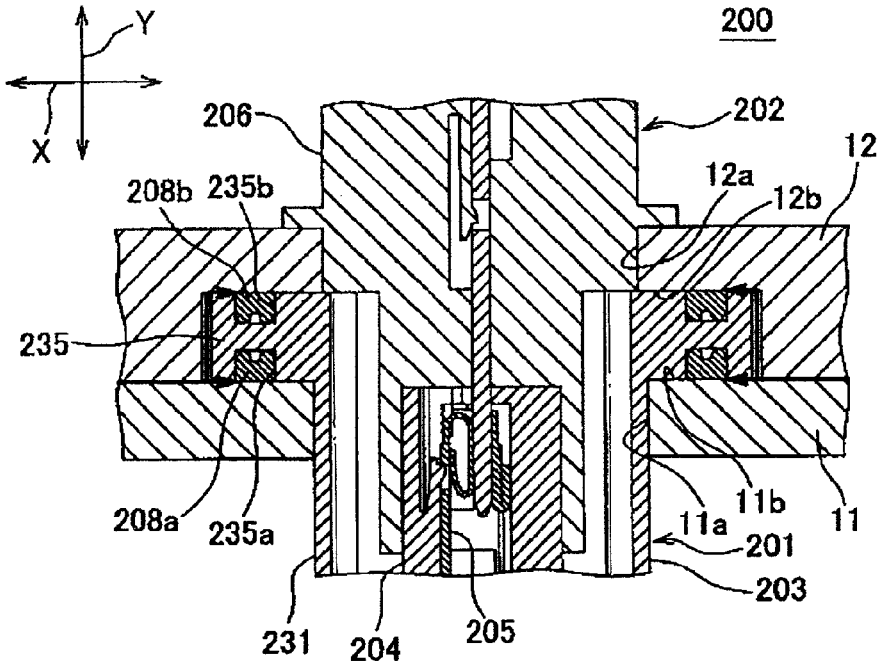
FIG. 4 is a cross-sectional view of the waterproof structure illustrated in FIG. 3.

The following describes a waterproof structure according to one embodiment of the present invention with reference to FIGS. 1 and 2.

A waterproof structure 100 is constructed to make waterproof (a) an inside of a case 11 of a motor, (b) an inside of a case 12 of an inverter, (c) an inside of a terminal accommodating portion 4 of a connector 1, and (d) an inside of a terminal accommodating portions 61 of a connector 2.

The connectors 1 and 2 are adapted to be connected to each other. The cases 11, 12 are made of metal. The connector 1 is fixed into a mounting hole 11*a* of the case 11 of the motor that is incorporated in an automobile. The connector 2 is fixed into the mounting hole 12*a* of the case 12 of the inverter.

Specifically, the waterproof structure 100 is a waterproof structure in the context of a structure where the inverter is mounted to the motor, the connectors 1, 2 are fixed to the cases 11, 12, and the connectors 1, 2 are directly connected to each other.

It should be noted that the "case 11" corresponds to "one case" in the context of the scope of claims, and the "case 12" corresponds to "the other case" in the context of the scope of claims. Also, the "connector 1" corresponds to "one connector" in the context of the scope of claims, and the "connector 2" corresponds to "the other connector" in the context of the scope of claims.

Also, an arrow Y in FIGS. 1 and 2 represents a fitting direction of the connector 1 and the connector 2, and an arrow X represents a direction orthogonal to the fitting direction.

The connector 1 comprises a terminal 5; a terminal accommodating portion 4 configured to accommodate a first electrical connection portion 51 of the terminal 5; an outer housing 3 fixed to the case 11 and formed in a shape of a cylinder having a bottom and opening toward the connector 2.

The outer housing 3 is adapted to accommodate therein the terminal accommodating portion 4 movably in the direction X orthogonal to the fitting direction Y.

It should be noted that the "terminal 5" corresponds to "one terminal" in the context of the scope of claims, and the "terminal accommodating portion 4" corresponds to the "one terminal accommodating portion" in the context of the scope of claims.

The terminal 5 includes the first electrical connection portion 51, which is a female-type terminal, adapted to be structurally and electrically connected to a terminal 7 of the connector 2, which is a male-type terminal; a second electrical connection portion 52 electrically connected to an electric circuit in the case 11 of the motor; and a connection part 53 provided between the first electrical connection portion 51 and the second electrical connection portion 52 and adapted to electrically connect the first electrical connection portion 51 to the second electrical connection portion 52.

The first electrical connection portion 51 is obtained by press working of a conductive metal. The first electrical connection portion 51 includes (a) a four-cornered cylindrical portion 56 in a shape of a quadrangular cylinder having corners and opening at the proximal side with respect to the connector 2 and (b) a biasing spring 57 provided inside of the cornered cylindrical portion 56 and adapted to spring-bias the terminal 7, which is inserted into the four-cornered cylindrical portion 56, toward an inner surface of the cornered cylindrical portion 56.

The second electrical connection portion 52 is made of conductive metal and formed in a shape of a plate, and includes a round hole 52*a* into which a bolt 9 is inserted when the electrical connection portion 52 is electrically connected to the electric circuit of the motor.

The connection part 53 includes a braided electric wire 54, which is a flexible conductive member, and an insulating sheath 55 covering the braided electric wire 54. The connection part 53 is electrically connected by means of ultrasonic bonding to the first electrical connection portion 51 and the second electrical connection portion 52.

The terminal accommodating portion 4 is made of synthetic resin and includes in one piece therewith (a) terminal accommodating portion body 40 having an external appearance in a shape of a quadrangular prism and being adapted to accommodate therein the first electrical connection portion 51 with the connection part 53 and the second electrical connection portion 52 extended via a rear end face of the first electrical connection portion 51, (b) a flange 41 extending from a rear end portion of the terminal accommodating portion body 40 and extending in a flange-like manner in the direction orthogonal to the fitting direction of the first electrical connection portion 51, the flange 40 having a shape of a ring, and (c) a plurality of elastic deformable arms 42 upstanding from the flange 41 toward a front end portion of the terminal accommodating portion body 40.

The terminal accommodating portion body 40 includes a terminal accommodating chamber 40*a* configured to accommodate the first electrical connection portion 51. Also, the terminal accommodating chamber 40*a* opens in two directions, i.e., toward a front end face of the terminal accommodating portion body 40, the front end face being a proximal end face with respect to the connector 2, and toward a rear end face of the terminal accommodating portion body 40, the rear end face being a distal end face with respect to the connector 2.

Further, an outer circumferential surface of the terminal accommodating portion body 40 includes a groove 40*b* provided in a ring shape extending on an entire outer circumference of the terminal accommodating portion body 40.

The groove 40*b* is provided such that it surrounds the terminal accommodating chamber 40*a* and opens outward of the terminal accommodating portion body 40 in the direction orthogonal to the fitting direction of the first electrical connection portion 51. Restated in a different way, the groove 40*b* is provided in a concave manner on the outer circumferential surface of the terminal accommodating portion body 40, the outer circumferential surface being configured to be brought into contact with a later-described inner circumferential surface 61*a* of the terminal accommodating portion 61 of the connector 2.

A ring-shaped third packing 8*d* is attached into the groove 40*b*. The third packing 8*d* is adapted to keep waterproof an interface between the outer circumferential surface of the terminal accommodating portion body 40 and the inner circumferential surface 61*a* of the terminal accommodating portion 61.

The flange 41 includes a groove 41*a* having a shape of a ring extending on an entire circumference of the flange 41. The groove 41*a* is provided such that the groove 41*a* surrounds an opening at the rear end face of the terminal accommodating chamber 40*a*. The groove 41*a* opens at the side of the first electrical connection portion 51 proximal to the second electrical connection portion 52 in the fitting direction. Specifically, the groove 41*a* extends in a shape of a dent on the surface of the flange 41 abutting a later-described inner bottom surface 31*b* of the outer housing 3.

A ring-shaped fourth packing 8*c* is attached into the groove 41*a*. The fourth packing 8*c* is in intimate contact with the inner bottom surface 31*b* such that the fourth packing 8*c* surrounds a later-described recess 32*a* provided in shape of a dent on the inner bottom surface 31*b* so as to make waterproof an interface between the inner bottom surface 31*b* and the terminal accommodating portion 4.

The elastic deformable arms 42 each have a shape curved in an arcuate manner and take a shape of an arc swollen outward of the terminal accommodating portion body 40 in the direction orthogonal to the fitting direction of the first electrical connection portion 51. Also, the elastic deformable arms 42 are spaced from each other such that the terminal accommodating portion body 40 is surrounded by these arms. The elastic deformable arms 42 are adapted to be elastically in contact with a later-described inner circumferential surface 31*a* of the cylindrical portion 31 of the outer housing 3.

The outer housing 3 is made of synthetic resin. The outer housing 3 includes in one piece therewith (a) cylindrical portion 31 extending in a shape of a cylinder in the fitting direction Y and having (i) an opening 30 opening toward the connector 2 and (ii) the inner bottom surface 31*b* at a distal side with respect to the opening 30, the cylindrical portion 31 having a shape of a cylinder having a bottom; (b) an extended portion 32 extended from the inner bottom surface 31*b* toward the distal side with respect to the opening 30; (c) a mounting portion 33 provided at one side of the extended portion 32, the side being a distal side with respect to the cylindrical portion 31; and (d) an overlapping portion 35 extending in a flange-like manner from an end of the cylindrical portion 31 where the opening 30 is provided, and extending outward of the cylindrical portion 31, the overlapping portion 35 being provided in a shape of a ring.

The cylindrical portion 31 is configured to accommodate therein the terminal accommodating portion 4 in an orientation where the front end face of the terminal accommodating portion body 40 is positioned at the side of the opening 30 and the flange 41 is positioned at the side of the inner bottom surface 31*b*. Also, an inner diameter of the cylindrical portion 31 is larger than an outer diameter of the terminal accommodating portion body 40 and an outer diameter of the flange 41. Further, all of the elastic deformable arms 42 of the terminal accommodating portions 4 accommodated in the cylindrical portion 31 are adapted to be elastically in contact with the inner circumferential surface 31*a* of the cylindrical portion 31. In this manner, the cylindrical portion 31 accommodates the terminal accommodating portion 4 movably in the direction indicated by the arrow X.

The terminal accommodating portion 4, restated in a different way, is accommodated in the cylindrical portion 31 in a state where there remains a space between the terminal accommodating portion 4 and the cylindrical portion 31. In this state, the terminal accommodating portion 4 is connected to the terminal accommodating portion 61 of the connector 2 inserted into the opening 30 of the cylindrical portion 31.

Also, if there exists a position gap between the connector 1 and the connector 2 in the direction indicated by the arrow X, the elastic deformable arm 42 is elastically deformed so that the terminal accommodating portion body 40 is displaced within the cylindrical portion 31 to absorb the position gap between the connector 1 and the connector 2 to ensure that, the counterpart's terminal 7 is inserted into the four-cornered cylindrical portion 56 of the first electrical connection portion 51 as the connectors 1, 2 are connected to each other, or restated in a different way, to ensure that the terminal accommodating portion body 40 is connected to the terminal accommodating portion 61.

Further, in the connector 1, the second electrical connection portion 52 of the terminal 5 is electrically connected to the first electrical connection portion 51 via the connection part 53 constructed by the braided electric wire 54, the second electrical connection portion 52 is not displaced even when the terminal accommodating portion 4 and the first electrical connection portion 51 are displaced as a result of fitting with the connector 2, and thus it is possible to prevent a stress from acting upon a connecting portion of the electric circuit of the motor to be connected to the second electrical connection portion 52.

The extended portion 32 includes a recess 32*a*. The recess 32*a* is provided in a shape of a dent on the inner bottom surface 31*b* of the cylindrical portion 31 and extended from the terminal accommodating chamber 40*a* of the terminal accommodating portion body 40. The recess 32*a* is adapted to position, inside thereof, the second electrical connection portion 52 and the connection part 53 protruding from the terminal accommodating portion body 40. Also, an inner bottom surface of the recess 32*a* includes a through-hole 34 that makes the end of the second electrical connection portion 52 protrude from a rear end face of the extended portion 32 toward the mounting portion 33, the end being a distal end with respect to the connection part 53. Also, a ring-shaped fifth packing 8*e* is attached between an inner circumferential surface of the through-hole 34 and the second electrical connection portion 52 so as to make waterproof an interface therebetween.

The mounting portion 33 is adapted to position on its surface an end of the second electrical connection portion 52 passing through the through-hole 34 and protruding out of the extended portion 32. Also, a nut 10 is attached to the mounting portion 33, the nut 10 being adapted to be brought into contact with a round hole 52*a* provided in the second electrical connection portion 52.

The second electrical connection portion 52 is fixed to the electric circuit of the case 11 of the motor by means of a bolt 9 and the nut 10 passing through the round hole 52*a* so that the second electrical connection portion 52 is electrically connected to the electric circuit.

The overlapping portion 35 is disposed on and in contact with the outer surface 11*b* of the case 11 and is formed in a shape of a ring surrounding the mounting hole 11*a* of the case 11. The overlapping portion 35 is fixed to the case 11 by means of a bolt 13.

The overlapping portion 35 includes a groove 35*a* provided in a shape of a dent on the surface abutting the outer surface 11*b* of the case 11 and takes a shape of a ring on an entire circumference of the overlapping portion 35.

A first packing 8*a* is attached to the groove 35*a*. The first packing 8*a* is in intimate contact with the outer surface 11*b* of the case 11 so that an interface between the case 11 and the connector 1 are made waterproof. Restated in a different way, the first packing 8*a* is provided at the interface between the surface of the case 11 and the surface of the connector 1, the surfaces being orthogonal to the fitting direction Y.

The connector 2 includes (a) a rod-like terminal 7 adapted to be connected to the first electrical connection portion 51 of the terminal 5 of the connector 1; and (b) a connector housing 6 accommodating the terminal 7 and fixed to the case 12. It should be noted that the "terminal 7" corresponds to "the other terminal" in the context of the scope of claims.

The connector housing 6 is made of synthetic resin. The connector housing 6 includes in one piece therewith a terminal accommodating portion 61, a mounting-hole-inserted portion 62, and a flange portion 63.

The terminal accommodating portion 61 has a shape of a cylinder having a bottom and extending in a shape of a cylinder in the fitting direction Y. The terminal accommodating portion 61 includes an opening 60 opening toward the connector 1 and an inner bottom surface 61*b* positioned at a distal side with respect to the opening 60.

The mounting-hole-inserted portion 62 is extended from the inner bottom surface 61*b* toward the distal side with respect to the opening 60.

The flange portion 63 extends in a flange-like manner from an outer circumferential surface of the mounting-hole-inserted portion 62 such that it takes a shape of a ring. Also, the flange portion 63 is disposed on and in contact with an inner surface of the case 12 and fixed to the case 12 by means of a bolt. It should be noted that the "terminal accommodating portion 61" corresponds to the "other terminal accommodating portion" in the context of the scope of claims.

The terminal accommodating portion 61 protrudes from the outer surface 12*b* of the case 12 toward the connector 1 such that the terminal accommodating portion 61 is closer to the connector 1 than the outer surface 12*b* of the case 12 is. Also, the terminal accommodating portion 61 is adapted to accommodate a tip of the terminal 7 protruding from the inner bottom surface 61*b* into the terminal accommodating portion 61, and is also adapted to accommodate therein the terminal accommodating portion body 40 of the connector 1.

When the terminal accommodating portion body 40 is inserted into the terminal accommodating portion 61, the terminal 7 is simultaneously inserted into the first electrical connection portion 51 of the terminal 5 so that the connector 1 is connected to the connector 2.

The mounting-hole-inserted portion 62 has an external appearance in a shape of a quadrangular prism and is positioned in the mounting hole 12*a* of the case 12. Also, the mounting-hole-inserted portion 62 includes an accommodating recess 62*a* provided in a concave manner on the inner bottom surface 61*b* of the terminal accommodating portion 61, and a locking arm 64 provided in the accommodating recess 62*a*. The locking arm 64 is adapted to be brought into locking engagement with a locking hole 70 of the terminal 7 accommodated in the accommodating recess 62*a* so that the terminal 7 is attached to the connector housing 6.

A groove 62*b* is provided in a shape of a ring on the outer circumferential surface of the mounting-hole-inserted portion 62 on an entire circumference thereof, The groove 62*b* is provided such that the accommodating recess 62*a* is surrounded thereby, and opens outward of the mounting-hole-inserted portion 62 in the direction orthogonal to the fitting direction of the terminal 7. Restated in a different manner, the groove 62*b* is provided in a shape of a dent on the outer circumferential surface of the mounting-hole-inserted portion 62 that is in contact with the inner circumferential surface of the mounting hole 12*a* of the case 12.

A ring-shaped second packing 8*b* is attached into the groove 62*b*. The second packing 8*b* is in an intimate contact with the inner circumferential surface of the mounting hole 12*a* of the case 12, so that an interface between the outer circumferential surface of the mounting-hole-inserted portion 62 and the inner circumferential surface of the mounting hole 12*a* are made waterproof. Restated in a different way, the second packing 8*b* is provided at the interface between the surface of the case 12 and the surface of the connector 2, the surfaces being parallel to the fitting direction Y.

Referring to FIG. 2 illustrating the above-described waterproof structure 100, when the connector 1 and the connector 2 are connected to each other, the outer surface 11*b* of the case 11 and the outer surface 12*b* of the case 12 are brought into abutment with each other in a state where there exists a small gap between the outer surface 12*b* of the case 12 and the overlapping portion 35 of the connector 1.

The first packing 8*a* makes waterproof the interface between the overlapping portion 35 and the outer surface 11*b* of the case 11, so that water that enters a space between the cases 11, 12, which is indicated by arrows in FIG. 2, is prevented from entering an inner space of the case 11 via the interface between the mounting hole 11*a* and the connector 1.

Also, the second packing 8*b* keeps waterproof the interface between the outer circumferential surface of the mounting-hole-inserted portion 62 and the inner circumferential surface of the mounting hole 12*a*, and thereby the water, which is indicated by the arrows in FIG. 2, entering a space between the outer surface 12*b* of the case 12 and the overlapping portion 35 is prevented from entering an inner space of the case 12 via the interface between the mounting hole 12*a* and the connector 2.

Further, the third packing 8*d* keeps waterproof the interface between the outer circumferential surface of the terminal accommodating portion body 40 and the inner circumferential surface 61*a* of the terminal accommodating portion 61, and thereby the water, which is indicated by the arrow in FIG. 2, entering a space between the outer housing 3 and the terminal accommodating portion 61 is prevented from entering an inner space of the terminal accommodating portion body 40 and the terminal accommodating portion 61.

Also, the fourth packing makes waterproof the interface between the inner bottom surface 31*b* of the outer housing 3 and the terminal accommodating portion 4, and thereby the water, which is indicated by the arrow in FIG. 2, entering a space between the outer housing 3 and the terminal accommodating portion 61 is prevented from entering inner spaces of the recess 32*a* and the terminal accommodating portion body 40.

Further, the fifth packing 8*e* makes waterproof the interface between the inner circumferential surface of the through-hole 34 and the second electrical connection portion 52, and thereby entry of the water into the case 11 via the through-hole 34 is prevented.

Also, in the present invention, since neither the first packing 8*a* nor the second packing 8*b* is provided between the case 11 and the case 12 or between the connector 1 and the connector 2, the connectors 1, 2 are not excessively pressed by the mating cases 11, 12 or the connectors 1, 2 when the connectors 1, 2 are connected to each other even when there is an error in assembly associated with the connectors 1, 2. Accordingly, it is possible to prevent an excessive stress from acting upon the connectors 1, 2 and avoid damage to the connectors 1, 2.

Further, if there exists a gap between the outer surface 11*b* of the case 11 and the outer surface 12*b* of the case 12, it is necessary to cover the gap by the electromagnetic shield member. In the present invention, since none of the packings 8*a*, 8*b*, 8*c*, 8*d*, and 8*e* is provided between the case 11 and the case 12 or between the connector 1 and the connector 2, the outer surface 11*b* of the metallic case 11 and the outer surface 12*b* of the metallic case 12 are brought into reliable abutment with each other, so that the aforementioned electromagnetic shield member does not need to be provided. Hence, the number of components can be reduced, which also facilitates separate collection of resources from end-of-life automobiles.

Also, in the present invention, the first packing 8*a* is not in contact with the case 12 or the connector 2, and the second packing 8*b* is not in contact with the case 11 or the connector 1. Accordingly, even when vibration occurs in the case 11 or the case 12, the first packing 8*a* will not experience friction with the case 12 or the connector 2 causing degradation of waterproof performance of the first packing 8*a*. Likewise, the second packing 8*b* will not experience friction with the case 11 or the connector 1 causing degradation of waterproof performance of the second packing 8*b*. In this manner, it is possible to provide reliable waterproofing property of the inner spaces of the cases 11, 12.

Although, in the above-described embodiment of the waterproof structure of the present invention, the connector 1 is fixed to the case 11 of the motor, and the connector 2 is fixed to the case 12 of the inverter, the one connector and the other connector may be fixed to any types of cases.

Also, in the above-described embodiment, the one connector 1 includes the terminal accommodating portion 4 accommodating the female first electrical connection portion 51, and the other connector 2 includes the cylindrical terminal accommodating portion 61 accommodating the male terminal 7. In the present invention, however, the other connector may include a terminal accommodating portion accommodating a female terminal, and the one connector may include a cylindrical terminal accommodating portion accommodating a male terminal.

It should be noted that the embodiment has only been illustrated as a typical one of the present invention, and the present invention is in no way limited to the illustrated embodiment. Hence, the present invention can be effectuated with various modifications made thereto within the scope of the present invention.

REFERENCE SIGNS

1 Connector (one connector)
2 Connector (the other connector)
3 Outer housing
4 Terminal accommodating portion (one terminal accommodating portion)
5 Terminal (the one terminal)
7 Terminal (the other terminal)
8*a* First packing
8*b* Second packing
8*d* Third packing
8*c* Fourth packing
11 Case (one case)
11*a* Mounting hole
12*a* Mounting hole
12 Case (the other case)
32*a* Recess
35 Overlapping portion
61 Terminal accommodating portion (the other terminal accommodating portion)
62 Mounting hole insertion portion
100 Waterproof structure

The invention claimed is:

1. A waterproof structure comprising:

one case;

an other case;

one connector fixed to a mounting hole of the one case;

an other connector fixed to a mounting hole of the other case, the one connecter being constructed to be connected to the other connector;

a ring-shaped first packing provided between a surface of the one case and a surface of the one connector and extending such that the mounting hole of the one case is surrounded thereby, the first packing being constructed to keep waterproof an interface between the one case and the one connector, wherein the surfaces of the one case and the one connector extend orthogonal to a fitting direction of the one connector with the other connector such that the interface between the one case and the one connector is defined by the surfaces of the one case and the one connector; and a ring-shaped second packing provided between a surface of the other case and an outer circumferential surface of the other connector such that the second packing extends on the outer circumferential surface of the other connector, the second packing being constructed to keep waterproof an interface between the other case and the outer circumferential surface of the other connector, wherein the surface of the other case and the outer circumferential surface of the other connector extend parallel to the fitting direction such that the interface between the other case and the other connector is defined by the surface of the other case and the outer circumferential surface of the other connector, wherein one of the one connector and the other connector includes a terminal accommodating portion configured to accommodate a terminal and an outer housing fixed to a corresponding one of the one case and the other case, the outer housing being provided in a shape of a cylinder having a bottom and opening toward another of the one connector and the other connector, the outer housing being configured to accommodate therein the terminal accommodating portion movably in the direction orthogonal to the fitting direction;

a recess is provided in a shape of a dent on an inner bottom surface of the outer housing and positioning therein the terminal protruding from the terminal accommodating portion; and a ring-shaped fourth packing is provided between the inner bottom surface of the outer housing and the terminal accommodating portion and is adapted to keep waterproof an interface between the inner bottom surface of the outer housing and the terminal accommodating portion, wherein the recess is surrounded by the fourth packing.

2. The waterproof structure of claim 1, wherein one of the one connector and the other connector includes one terminal accommodating portion configured to accommodate one terminal;

an other of the one connector and the other connector includes an other terminal accommodating portion configured to accommodate an other terminal adapted to be connected to the one terminal, the other terminal accommodating portion having a cylindrical shape and being configured to accommodate therein the one terminal accommodating portion; and a ring-shaped third packing is provided between an outer circumferential surface of the one terminal accommodating portion and an inner circumferential surface of the other terminal accommodating portion, the third packing being constructed to keep waterproof an interface between the outer circumferential surface of the one terminal accommodating portion and the inner circumferential surface of the other terminal accommodating portion, wherein the interface is defined by the outer circumferential surface and the inner circumferential surface.

3. The waterproof structure of claim 2, wherein the one connector includes a ring-shaped overlapping portion extending such that the mounting hole of the one case is surrounded by the overlapping portion, the overlapping portion being configured to be disposed on and in contact with an outer surface of the one case, and the first packing is attached to the overlapping portion such that the first packing is in intimate contact with the outer surface of the one case.

4. The waterproof structure of claim 2, wherein the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

5. The waterproof structure of claim 1, wherein one of the one connector and the other connector includes a terminal accommodating portion configured to accommodate a terminal and an outer housing fixed to a corresponding one of the one case and the other case, the outer housing being provided in a shape of a cylinder having a bottom and opening toward the other one of the one connector and the other connector, the outer housing being configured to accommodate therein the terminal accommodating portion movably in the direction orthogonal to the fitting direction.

6. The waterproof structure of claim 1, wherein one of the one connector and the other connector includes one terminal accommodating portion configured to accommodate one terminal, and the other one of the one connector and the other connector includes another terminal accommodating portion configured to accommodate another terminal configured to be connected to the one terminal, and the other terminal accommodating portion having a cylindrical shape and being configured to accommodate therein the one terminal accommodating portion.

7. The waterproof structure of claim 1, wherein the one connector includes a ring-shaped overlapping portion extending such that the mounting hole of the one case is surrounded by the overlapping portion, the overlapping portion being configured to be disposed on and in contact with an outer surface of the one case, and the first packing is attached to the overlapping portion such that the first packing is in intimate contact with the outer surface of the one case.

8. The waterproof structure of claim 7, wherein the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

9. The waterproof structure of claim 1, wherein the other connector includes a mounting-hole-inserted portion adapted to be positioned inside of the mounting hole of the other case, and the second packing is attached to an outer circumferential surface of the mounting-hole-inserted portion such that the second packing is in intimate contact with an inner circumferential surface of the mounting hole of the other case.

* * * * *